US006005515A

United States Patent [19]

Allen et al.

[11] Patent Number: 6,005,515

[45] Date of Patent: Dec. 21, 1999

[54] MULTIPLE SCANNING BEAM DIRECT RADIATING ARRAY AND METHOD FOR ITS USE

[75] Inventors: Barry R. Allen, Redondo Beach; Kenneth T. Yano; Chun-Hong H. Chen, both of Torrance, all of Calif.

[73] Assignee: TRW Inc., Redondo Beach, Calif.

[21] Appl. No.: 09/289,414

[22] Filed: Apr. 9, 1999

[51] Int. Cl.[6] ..... H01Q 3/02; H01Q 3/12

[52] U.S. Cl. ..... 342/374; 342/368; 342/372; 342/373

[58] Field of Search ..... 342/368, 371–374, 342/154, 157, 81

[56] References Cited

U.S. PATENT DOCUMENTS

| | | | |
|---|---|---|---|
| 4,129,870 | 12/1978 | Toman | 343/106 R |
| 5,734,345 | 3/1998 | Chen et al. | 342/74 |
| 5,760,741 | 6/1998 | Huynh et al. | 342/373 |
| 5,771,016 | 6/1998 | Mullins et al. | 342/372 |

*Primary Examiner*—Thomas H. Tarcza
*Assistant Examiner*—Dao L. Phan
*Attorney, Agent, or Firm*—Michael S. Yatsko

[57] ABSTRACT

A phased array antenna system producing multiple beams that can be rapidly and reliably scanned between desired angular beam locations without the need for highly complex hardware. The antenna system includes multiple antenna elements (30) coupled to frequency converters (34) that downconvert received signals to an intermediate frequency. Each frequency converter (34) receives a local oscillator (36) signal that passes through a phase shifting circuit (40). The phase shifting circuits are adjusted only in a calibration mode, to remove any phase errors, but are not used to select beam locations. In a receive mode, the downconverted received signals are input to a matrix network (44), such as a Butler Matrix, which transforms the antenna signals on its input lines (42) to an equivalent set of beam location signals on its outputs (46), of which there is one for each possible angular beam location of the antenna system. A switch network (50) then selects from among this set of beam location signals and associates selected beam location signals with selected beam signals. The switch network (50) has its configuration determined by multiple electronically controllable switches (58), and determines the association of each of multiple communication beams with a selected angular beam location. Thus each communication beam can be conveniently directed or redirected to a desired angular beam location without the need to adjust a large number of phase shifting circuits.

10 Claims, 3 Drawing Sheets

MULTIPLE SCANNING BEAM DIRECT RADIATING ARRAY AND METHOD FOR ITS USE

BACKGROUND OF THE INVENTION

This invention relates generally to phased array antennas and, more particularly, to phased array antenna systems that must provide multiple beams simultaneously. By adjusting the phase angles of signals received from or transmitted to multiple antenna elements in an antenna array, an antenna control system effectively steers the antenna beam, whether in a receive mode or a transmit mode. In satellite communication systems, it is highly desirable to be able to provide phased array antenna systems with highly agile beams, which can be scanned both rapidly and accurately between beam locations. It is also desirable to provide on-orbit re-configurabilty of such an antenna system, to switch rapidly between different beam configurations as needed.

In both commercial and military satellite communication systems, antenna arrays must be controlled to produce relatively narrow beams, as small as one degree in width. Each narrow beam covers only a relatively small, approximately circular area of the earth's surface. Besides being more energy efficient, the use of narrow beams permits multiple ground stations to use the same radio frequency without conflict. Also modern satellite communication systems need the ability to transmit or receive over multiple beams simultaneously. As the number of required multiple beams increases, so does the complexity of the phased array antenna control circuitry.

In conventional phased array antenna systems, each radiating element in the array has to have an independent radio-frequency (RF) phase shifting circuit for each independent beam to be produced. In an illustrative system to be discussed in more detail below, the array has 547 elements and there is a requirement to produce sixteen independent beams. Thus, 8,752 phase shifting circuits are needed, together with sixteen 547-way RF power combiners to produce the sixteen independent beams. Each phase shifting circuit has to be connected to an appropriate one of the power combiners, creating a maze of crossing lines. Moreover, each of the phase shifting circuits requires its own four-bit control line to provide the requisite beam steering accuracy. The complexity of implementation increases even further as the number of independent beams rises above a modest value.

Accordingly, it will be appreciated that there is a need for a less complex technique to provide multiple independent beams from a phased array antenna system. The present invention is directed to this end.

SUMMARY OF THE INVENTION

The present invention resides in a phased array antenna system in which multiple independent beams are conveniently directed or redirected to desired angular beam locations. Briefly, and in general terms, the phased array antenna system of the invention comprises a first plurality of antenna elements operable at radio frequencies (RF) in a receive mode or a transmit mode; an equal plurality of frequency converters coupled to the antenna elements to effect a frequency conversion of received RF signals to an intermediate frequency; a local oscillator providing a local oscillator frequency signal to the frequency converters; an equal plurality of phase shifting circuits, connected between the local oscillator and each of the frequency converters, to permit phase adjustment of the local oscillator frequency signal provided to each of the frequency converters; a matrix network having a first plurality of input ports equal in number to the number of antenna elements, and a second plurality of output ports equal in number to a desired number of possible angular beam locations, wherein the matrix network effects a transformation from a set of antenna element signals to a set of beam location signals; and a switch network having a second plurality of input ports coupled to respective output ports of the matrix network, and a third plurality of output ports equal in number to a selected number of beams used as separate communication channels. The switch network selects a beam location from the second plurality of beam locations, and couples signals from the selected beam location to a selected beam output port; and each beam can be quickly assigned to any one or more angular beam locations.

More specifically, the matrix network is implemented in the form of a Butler Matrix, a Blass Matrix Network, or Rotman Lens Network. The switch network includes a second plurality of splitters, a third plurality of switches for each of the splitters, and a third plurality of combiners. The splitters are equal in number to the number of input ports in the switch network, each having a single input port connected to an output port the matrix network and a third plurality of output ports, equal in number to the number beams. Each of the switches is connected to a separate output port of a splitter. The combiners are also equal in number to the number of beams. Each combiner has a single output port that is an output port of the switch network, and has a second plurality of input ports, equal in number to the number of input ports to the switch matrix. Therefore, each input port of the switch matrix is connectable to any of the output ports of the switch matrix, through one of the splitters, one of the switches and one of the combiners. The switches are operable to associate any selected beam with any selected beam location.

The antenna system is also operable in a transmit mode in which the switch network functions to associate selected beam signals to selected beam location signals; the matrix network functions to transform a plurality of beam location signals to antenna array signals; and each frequency converter performs an upconversion from an intermediate frequency to a radio frequency.

In method terms, the invention, comprises the steps of receiving radio-frequency (RF) signals through a first plurality of antenna elements in an array; downconverting the received signals to an intermediate frequency in an equal plurality of frequency converters, wherein the downconverting step includes generating a local oscillator signal, splitting the local oscillator signal into a first plurality of local oscillator signals for connection to the frequency converters, and adjusting the phase of the local oscillator signals applied to the frequency converters to compensate for any phase errors; outputting from the frequency converters a first plurality of downconverted received signals; transforming the first plurality of downconverted signals to a second plurality of signals, corresponding in number to a selected number of angular beam locations to which the phased array antenna is capable of being pointed; and selecting from the second plurality of signals a set of beam signals, of which there is one for each of a desired plurality of communication channels. The selecting step provides for rapid and reliable switching of beams to different angular beam locations.

More specifically, the selecting step includes splitting each of the second plurality of signals into a third plurality of signals; connecting the third plurality of signals from each splitting step to input ports of a third plurality of signal combiners, through a third plurality of controllable switches; controlling the switches to select which of the second plurality of signals, corresponding to different angular beam locations, are connected to the signal combiners. The selected signals are then output as beam signals from the signal combiners.

There are various possibilities for associating beam signals with beam locations. One possibility is that the controlling step selects a single angular beam location signal to assign to each beam signal. Alternatively, the controlling step selects multiple angular beam location signals to assign to each of some of the beam signals. Or the controlling step selects a single angular beam location signal to assign to multiple beam signals.

Other aspects and advantages of the invention will become apparent from the following more detailed description, taken in conjunction with the accompanying drawings.

DESCRIPTION OF THE PREFERRED EMBODIMENT

Figure 1:
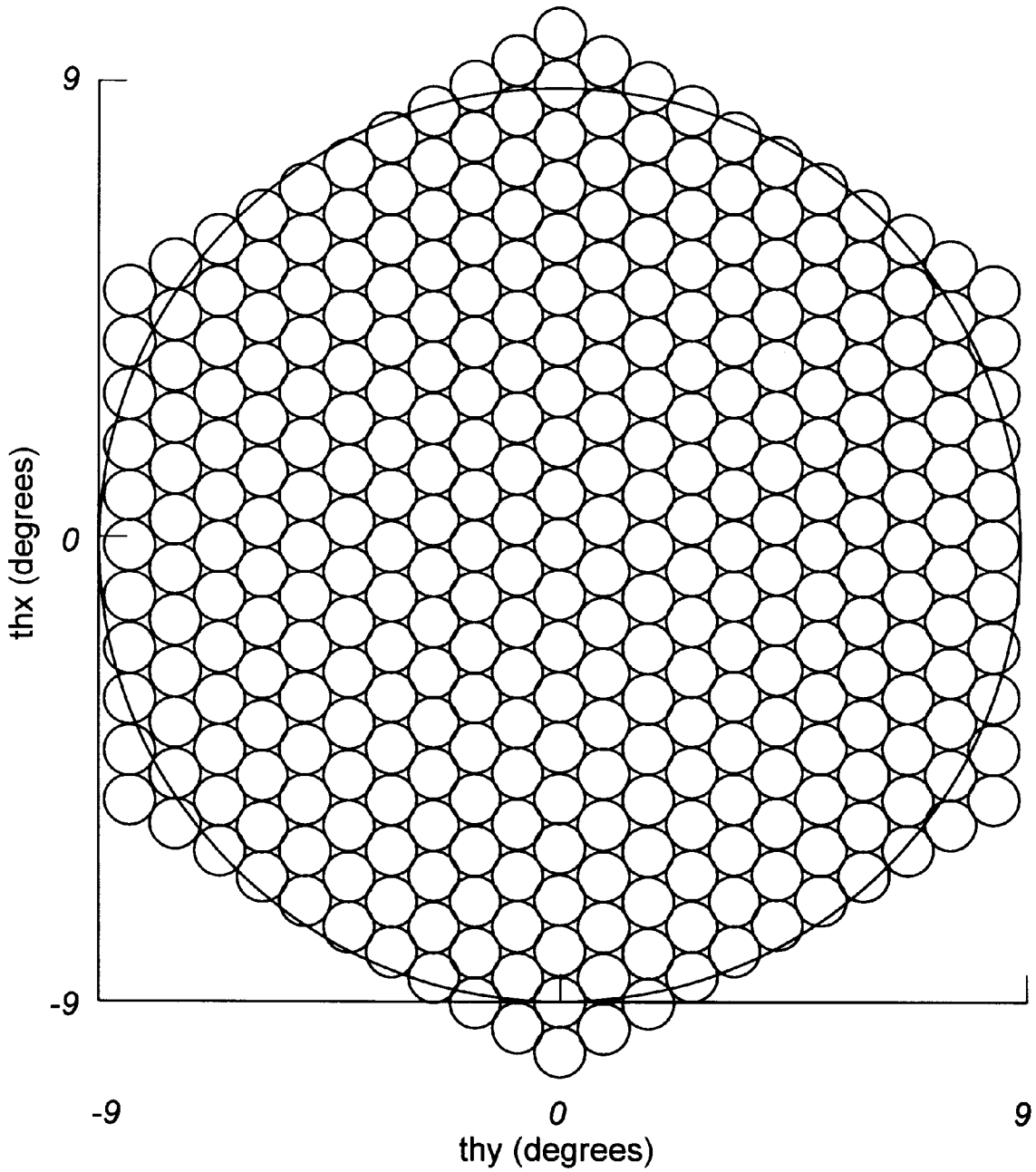
FIG. 1 is a diagram showing the field of view from geosynchronous earth orbit (GEO), and also showing communication coverage of the earth with 313 one-degree beam locations in a hexagonal configuration.

As shown in the drawings by way of illustration, the present invention pertains to phased array antenna systems for producing multiple independent beams simultaneously. In satellite communication system, it is often a requirement for antennas to be able to handle multiple beams directed toward different ground stations or communication terminals. As shown in FIG.1, coverage of the earth's surface as viewed from a geosynchronous orbit can be achieved with a total of 313 beam locations using a one-degree beam diameter. The angular diameter of the earth as viewed from geosynchronous orbit is approximately 18E. The large circle in FIG. 1 represents the earth and each of the small circles represents a beam location with a one-degree diameter. When the 313 beam locations shown are arranged in a hexagon pattern with eleven beam locations along each side, the pattern approximately overlaps the earth's disk in the field of view.

Figure 2:
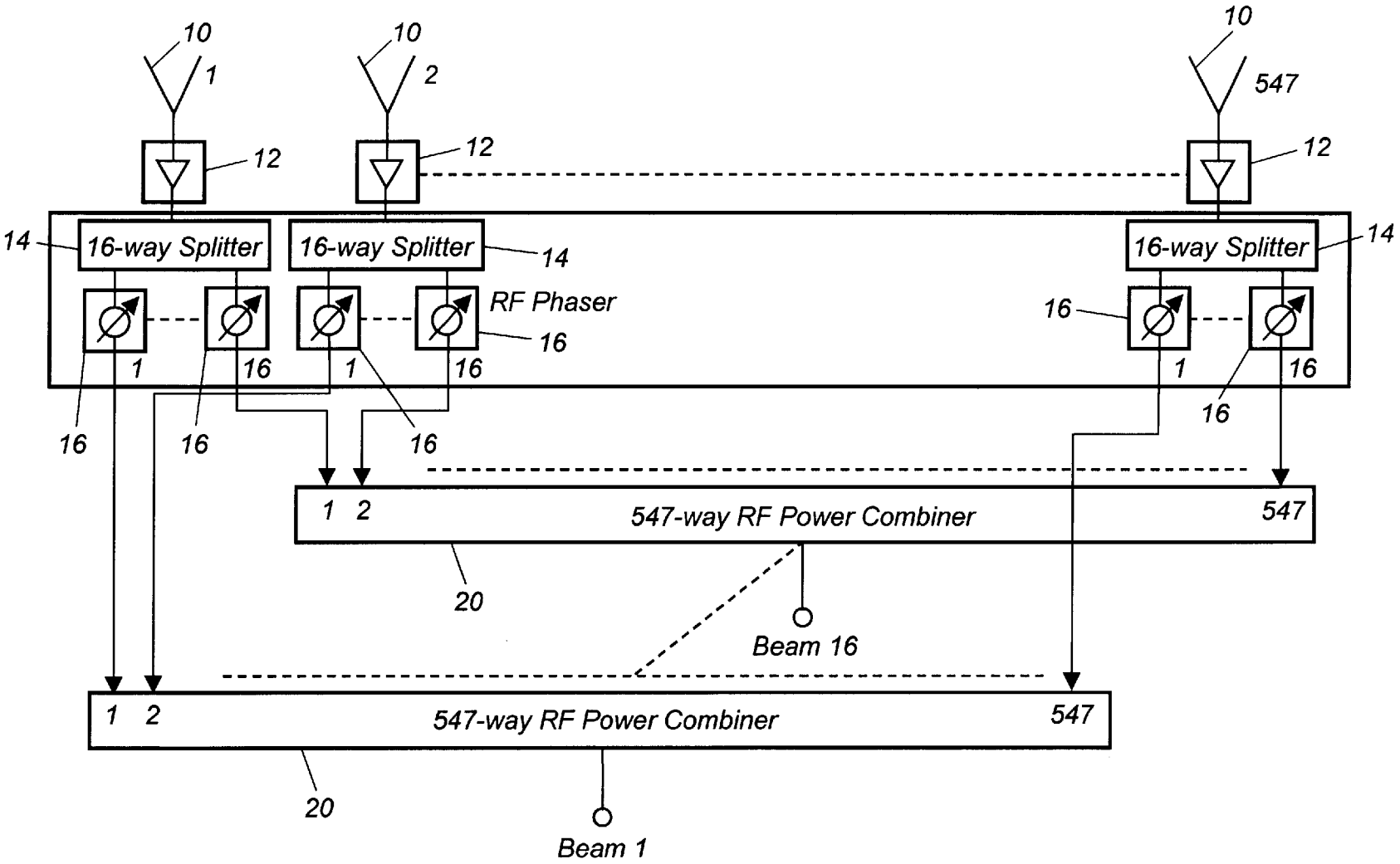
FIG. 2 is a block diagram of a conventional phased array antenna system.

The 313 beam locations shown in FIG.1 represent the possible angular locations of multiple beams generated at a phased array antenna on a communication satellite in geosynchronous earth orbit. FIG. 2 shows a phased array antenna system of the prior art, for generating up to sixteen independent beams directed to angular beam locations selected from the ones shown in FIG. 1.

The phased array antenna system of FIG. 2 has 547 radiating antenna elements, indicated by reference numeral 10. For simplicity, only the first two and the last elements are shown. In this description, it is assumed that the antenna system is operating in a receive mode. Each antenna element 10 is coupled through an amplifier 12 to a 16-way splitter 14, which provides sixteen parallel connections to the antenna element. Each of the sixteen lines from the 16-way splitter 14 is coupled to a phase shifting circuit 16. Therefore, there are sixteen phase shifting circuits for each antenna element 10, or a total of 8,752 phase shifting circuits 16.

Finally, the phased array antenna system includes sixteen 547-way RF power combiners 20, only the first and last of which are shown. The first power combiner 20, shown in the lower position in the drawing, receives as inputs the RF signals from each of the phase shifting circuits 16 that are in the first position as shown in the figure. This set of 547 phase shifting circuits is controlled by appropriate control signals to the separate phase shifters, to produce a beam designated "beam 1." Similarly, each other set of 547 phase shifters is connected to its own power combiner 20 to produce an independent beam, of which there are sixteen in all in this illustration.

There are a number of significant problems associated with the conventional phased array antenna system of FIG. 2, one of which is its complexity. A large number of phase shifting circuits 16 must be accurately adjusted and connected to appropriate RF power combiners 20. Wiring to control the phase shifters 16 and the interconnecting wiring to the power combiners both present significant challenges because the inter-element spacing of the antenna elements 10 is fixed and is relatively small. A second major concern with the conventional system is its potential slowness to switch or reconfigure beams to different angular locations. In the system of FIG. 2, beam scanning or switching is achieved by changing the settings of the phase shifting circuits 16. Inevitably, there is a delay or "settling time" involved when the settings of a group of 547 phase shifting circuits 16 are changed to move a beam to a new location. A related difficulty is that RF phase shifting circuits are notoriously susceptible to inaccuracies attributable to various causes, such as manufacturing tolerances or changes in temperature.

In accordance with the present invention, the foregoing difficulties are completely avoided. Specifically, only one phase shifting circuit is required for each antenna element, for purposes of calibration only, and scanning or switching beam locations is accomplished practically instantaneously by switches instead of phase shifting circuits.

Figure 3:
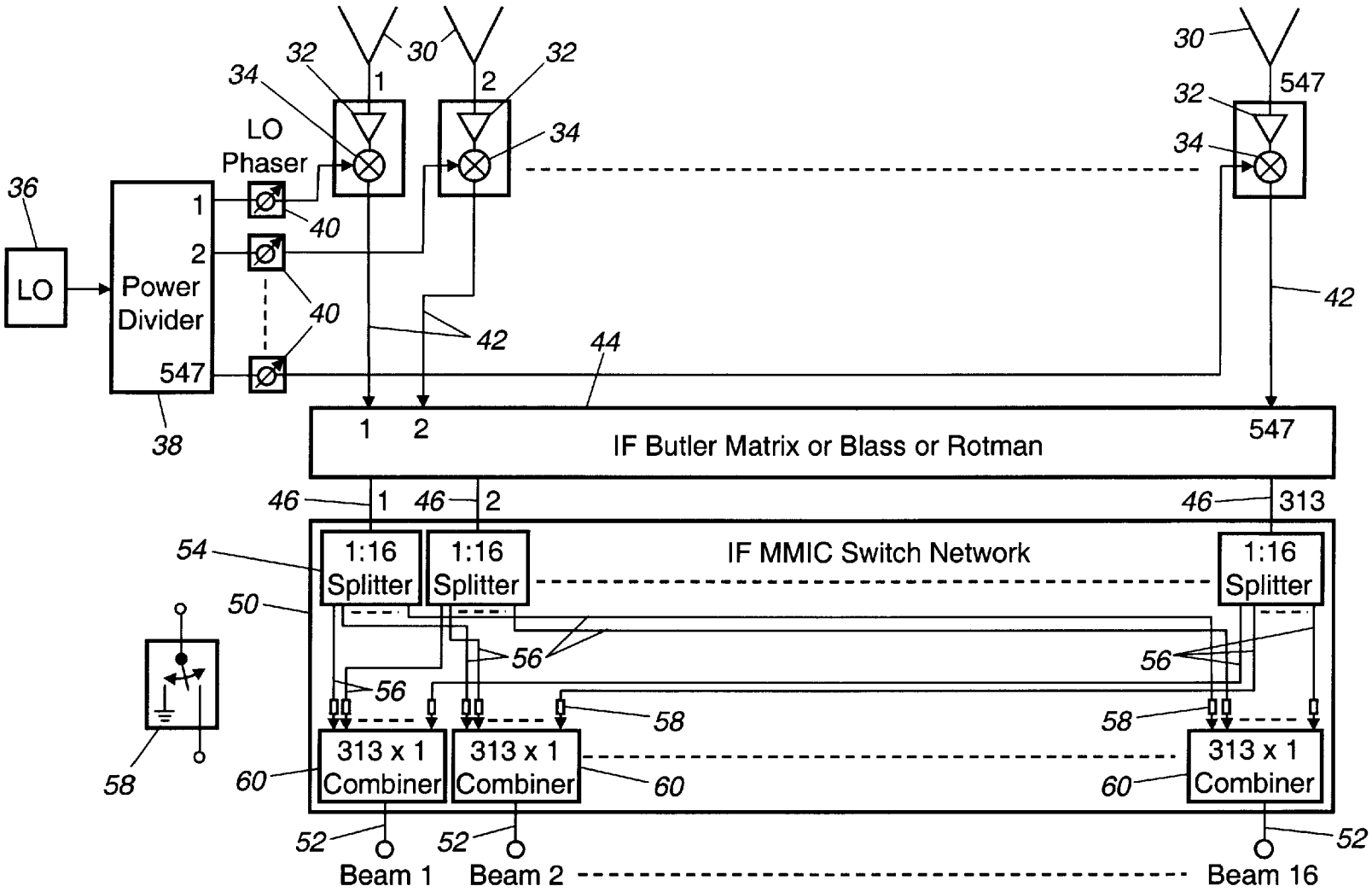
FIG. 3 is a block diagram of a phased array antenna system in accordance with the present invention.

As shown in FIG. 3, the phased array antenna system of the present invention also has 547 antenna elements 30, but it will be understood that the invention is not limited to the numerical values used in this illustrative embodiment. Coupled to each antenna element 30 is a low-noise amplifier (LNA) 32 and a downconverter 34, which shifts the frequency of received radio-frequency (RF) signals, at 44 gigahertz (GHz), for example, to an intermediate frequency (IF). Associated with the downconverters 34 is a local oscillator 36, which supplies a local oscillator (LO) signal to a power divider 38 that splits the LO signal into 547 paths, one for each of the downconverters 34. Each of the 547 LO signals passes through a separate phase-shifting circuit 40. Adjustment of the phase of the LO signal also serves to adjust the phase of the intermediate frequency (IF) signal output from the downconverter 34 on line 42. These phase adjustments are performed only during a calibration procedure to ensure phase tracking along all signal paths, and not for beam steering as in the conventional system of FIG. 2. This approach greatly reduces demand on the antenna control system. Also, because the phase shifting circuits 40 operate at the LO frequency, which is lower than the radio frequency, they are less sensitive to manufacturing tolerances and changes in operating temperature. Moreover, packaging is greatly simplified because the LNA 32 and downconverter 34 adjacent to each antenna element 30 occupies much less space than the sixteen phase shifters required in the conventional system of FIG. 2.

The 547 outputs on lines 42 from the downconverters 34 are input to an IF matrix network 44, which may be a Butler Matrix, a Blass Matrix Network or a Rotman Lens Network. The matrix network 44 functions to convert, in the receive mode, the set of 547 "feed" signals to an equivalent set of 313 "beam" signals, one for each possible angular beam location. In a transmit mode, the matrix network 44 performs the opposite conversion function. The matrix network 44 is best disclosed in U.S. Pat. No. 5,734,345 issued to Chen et al., assigned to the same assignee as the present application and having the title, "Antenna System for Controlling and Redirecting Communications Beams," and in U.S. Pat. No. 5,760,741 issued to Huynh et al., assigned to the same assignee as the present application and having the title, "Beam Forming Network for Multiple-Beam-Feed Sharing Antenna System." Both of these patents are hereby incorporated by reference into this specification. The beam forming network (14 in FIG. 7 of U.S. Pat. No. 5,734,345) performs the same function as the matrix network 44 of the present invention.

The outputs of the matrix network 44 operating in a receive mode, on lines 46, correspond to the 313 possible angular beam locations of the antenna array. The other principal component of the invention is an intermediate frequency (IF) switch network 50, which associates selected output lines 46 with beams #1 through #16, as indicated by lines 52. The switch network 50 includes a plurality of 1:16 splitters 54, one for each of the lines 46 from the matrix network 44. Each splitter 54 has one input and sixteen outputs, indicated by lines 56, most of which have been omitted for clarity. Each of the lines 56 passes through a separate electronically controllable switch 58. Finally, the IF switch network 50 includes sixteen 313H1 combiners 60, each having 313 inputs, on lines 56, and a single output, on one of the lines 52. The connecting lines 56 between the splitters 54 and the combiners 60 are routed such that each combiner receives a potential signal contribution from every one of the splitters 54. For example, the first combiner 60 is connected to the first output position of each of the splitters 54; the second combiner is connected to the second output position of each of the splitters, and so forth.

In operation in a receive mode in which all sixteen beams are enabled, each combiner 60 will have only one of its associated input switches 58 closed. In other words, each combiner 60 is associated with one particular beam location. Typically, the sixteen combiners 60 will be associated with sixteen different beam locations selected from the 313 possible locations, but other associations of the beams and beam locations are also possible. A single beam, which constitutes an independent communication channel, may be associated with multiple beam locations at the same time, or multiple beams may be associated with a single beam location. Switching a beam from one angular location to another is accomplished by control of the switches 58. No readjustment of phase delays of the antenna elements is needed. Once the switches 58 have settled in their new positions, the antenna beams immediately assume their new configuration.

It will be well understood by those familiar with the antenna art that phased array antennas may be operated in either a transmit mode or a receive mode. For convenience, the invention and the prior art have been described primarily as operating in the receive mode, but could have been described as operating in the transmit mode. For example, in the transmit mode the combiners 60 would function as splitters, and the splitters 54 would function as combiners. The matrix network 44 would, as mentioned above, operate in the transmit mode to perform a transformation from 313 beam location inputs to 547 antenna element outputs. Also the downconverters 34 would function as upconverters, and the low-noise amplifiers 32 would be replaced by solid-state power amplifiers in the transmit mode.

It will be appreciated from the foregoing that the present invention represents a significant advance in the field of phased array antennas for satellite communication systems. In particular, the invention provides a less complex technique for switching multiple communication beams from one angular beam location to another, without the need for thousands of RF phase shifting circuits and associated interconnected control wiring. The solution provided by the present invention allows more rapid and reliable switching between beam locations, with substantially less hardware complexity. It will also be appreciated that, although a specific embodiment of the invention has been described in detail by way of illustration, various modifications may be made without departing from the spirit and scope of the invention. Accordingly, the invention should not be limited except as by the appended claims.

What is claimed is:

1. A phased array antenna system, comprising:

a first plurality of antenna elements operable at radio frequencies (RF) in a receive mode or a transmit mode;

an equal plurality of frequency converters coupled to the antenna elements to effect a frequency conversion of received RF signals to an intermediate frequency;

a local oscillator providing a local oscillator frequency signal to the frequency converters;

an equal plurality of phase shifting circuits, connected between the local oscillator and each of the frequency converters, to permit phase adjustment of the local oscillator frequency signal provided to each of the frequency converters;

a matrix network having a first plurality of input ports equal in number to the number of antenna elements, and a second plurality of output ports equal in number to a desired number of possible angular beam locations, wherein the matrix network effects a transformation from a set of antenna element signals to a set of beam location signals; and a switch network having a second plurality of input ports coupled to respective output ports of the matrix network, and a third plurality of output ports equal in number to a selected number of beams used as separate communication channels, wherein the switch network selects a beam location from the second plurality of beam locations, and couples signals from the selected beam location to a selected beam output port; and wherein each beam can be quickly assigned to any one or more angular beam locations.

2. A phased array antenna system as defined in claim 1, wherein:

the matrix network is implemented in a form selected from the group consisting of a Butler Matrix, a Blass Matrix Network, and Rotman Lens Network.

3. A phased array antenna system as defined in claim 1, wherein the switch network includes:

a second plurality of splitters, equal in number to the number of input ports in the switch network, each having a single input port connected to an output port the matrix network and a third plurality of output ports, equal in number to the number beams;

a third plurality of switches for each of the splitters, each switch being connected to a separated output port of the splitter;

a third plurality of combiners, equal in number to the number of beams, wherein each combiner has a single output port that is an output port of the switch network, and has a second plurality of input ports, equal in number to the number of input ports to the switch matrix;

wherein each input port of the switch matrix is connectable to any of the output ports of the switch matrix, through one of the splitters, one of the switches and one of the combiners;

and wherein the switches are operable to associate any selected beam with any selected beam location.

4. A phased array antenna system as defined in claim 3, wherein:

the matrix network is implemented in a form selected from the group consisting of a Butler Matrix, a Blass Matrix Network, and Roman Lens Network.

5. A phased array antenna system as defined in claim 1, wherein the system is also operable in a transmit mode in which:

the switch network functions to associate selected beam signals to selected beam location signals;

the matrix network functions to transform a plurality of beam location signals to antenna array signals; and the frequency converter performs an upconversion from an intermediate frequency to a radio frequency.

6. A method of operation of a phased array antenna system, the method comprising the steps of:

receiving radio-frequency (RF) signals through a first plurality of antenna elements in an array;

downconverting the received signals to an intermediate frequency in an equal plurality of frequency converters, wherein the downconverting step includes generating a local oscillator signal, splitting the local oscillator signal into a first plurality of local oscillator signals for connection to the frequency converters, and adjusting the phase of the local oscillator signals applied to the frequency converters to compensate for any phase errors;

outputting from the frequency converters a first plurality of downconverted received signals;

transforming the first plurality of downconverted signals to a second plurality of signals, corresponding in number to a selected number of angular beam locations to which the phased array antenna is capable of being pointed; and selecting from the second plurality of signals a set of beam signals, of which there is one for each of a desired plurality of communication channels;

wherein the selecting step provides for rapid and reliable switching of beams to different angular beam locations.

7. A method as defined in claim 6, wherein the selecting step includes:

splitting each of the second plurality of signals into a third plurality of signals;

connecting the third plurality of signals from each splitting step to input ports of a third plurality of signal combiners, through a third plurality of controllable switches; and controlling the switches to select which of the second plurality of signals, corresponding to different angular beam locations, are connected to the signal combiners, wherein the selected signals are output as beam signals from the signal combiners.

8. A method as defined in claim 7, wherein:

the controlling step selects a single angular beam location signal to assign to each beam signal.

9. A method as defined in claim 7, wherein:

the controlling step selects multiple angular beam location signals to assign to each of some of the beam signals.

10. A method as defined in claim 7, wherein:

the controlling step selects a single angular beam location signal to assign to multiple beam signals.

* * * * *